United States Patent [19]

Harz

[11] Patent Number: 4,488,722

[45] Date of Patent: Dec. 18, 1984

[54] SAFETY TENNIS RACQUET

[76] Inventor: Gunter Harz, 4415 Pine St., Omaha, Nebr. 68105

[21] Appl. No.: 315,895

[22] Filed: Oct. 28, 1981

[51] Int. Cl.[3] ..... A63B 51/06

[52] U.S. Cl. ..... 273/73 D

[58] Field of Search ..... 273/73 R, 73 C, 73 D, 273/73 A

[56] References Cited

U.S. PATENT DOCUMENTS

| | | | |
|---|---|---|---|
| 1,132,214 | 3/1915 | Ries et al. | 273/73 D |
| 4,190,249 | 2/1980 | Fischer | 273/73 D |
| 4,249,731 | 2/1981 | Amster | 273/73 D |
| 4,273,331 | 6/1981 | Fischer | 273/73 D |

FOREIGN PATENT DOCUMENTS

| | | | |
|---|---|---|---|
| 2656082 | 6/1978 | Fed. Rep. of Germany | 273/73 D |

*Primary Examiner*—Richard C. Pinkham
*Assistant Examiner*—Matthew Schneider
*Attorney, Agent, or Firm*—Hiram A. Sturges

[57] ABSTRACT

A tennis racquet having at least mostly non-interwoven strings, a plurality of ball grips or string-protectors, each ball grip having an opening therethrough receiving a respective main string, retaining units holding each of the grips in a position along its main string, the grips being preferably multiple row-groups of grip-tubes each row-group being held together as a unit and called a spinner, the spinners being disposed spaced along the mains.

12 Claims, 3 Drawing Figures

SAFETY TENNIS RACQUET

BACKGROUND OF THE INVENTION

The traditional method of stringing tennis racquets with interwoven strings has resulted in a relatively hard, unyielding string surface, whereby the ball bounces quickly off of the conventional racquet. The result is that the player has little contact of the racquet and ball with which to achieve ball control.

Ball control is very important in order to provide top spin so that a ball tends to curve downward and land in the court rather than going straight and falling outside the court.

Another disadvantage of the conventional stringing is that in hard-hitting, the vibrations have been transferred from the strings to the player's elbow and shoulders, causing the common injuries known as "tennis elbow" and "tennis shoulder".

A further disadvantage of conventional stringing has been that the strings present a total area which is larger than desirable causing wind resistance and slowing down the swinging of the racquet. It is important in hard play, and also important for amateurs, that it be possible to swing a racquet as quickly as possible. This is because the tiniest fraction of a second difference can cause the ball, either to be struck while it is at the right place, or else too far forward or too far rearward with respect to the player, making accuracy very difficult.

I have done research into the matter of stringing tennis racquets much more loosely and with strings that are not interwoven.

The result was that because the strings could yield, the contact of the strings with the ball was longer and a greater ball control was achievable. When applying a turning motion of the racquet head across the top of the back of the ball, the effect was that the main strings could yield downwardly at first, and then as they regained their positions by moving upwardly with respect to the frame, they would give a great amount of spin to the ball, causing it to curve down into the court in a desirable manner.

However, I found that the strain on strings hitting a ball was great to the end that strings could break from being twisted. Later I conceived of the idea of having tubes, slightly larger than the strings in outer diameter, disposed on the main strings and glued in place. I then attached together a row of such tubes, having a row extending along a cross-string, then all tubes in a row worked together as a unit, shifting together as a unit with respect to the frame and causing the main strings extending through the tubes of the row to shift only as a unit. This had the result of causing each string to be supported by other strings connected to the same row of tubes, reducing breakage. Since such a row of tubes and the portions connecting the tubes tend to put spin on a ball, they can together be called a spin-making unit or spinner.

I found that a system of main strings on one side of a racquet, and spinners connected thereto, will tend to shift only as a unit with respect to the frame, whereby such a unit reinforces all parts of the unit, preventing the various strings from twisting and breaking and for providing an effective unitary spin control on the ball.

I prefer that the tubes of a row be connected by connecting sections that are of one piece with the tubes of that row so that an entire spinner can be made of one piece of thermo-plastic material for economical molding. The stiffness of each spinner, therefore, holds the tubes of that spinner in exact spacing. I have also discovered that by having the tubes of a row all connected together by stiff plastic connecting portions that such one-piece spinners make the racquet easier to string and quicker to string.

I discovered that glue will move by capillary action through the tubes when glue is placed at one end for making the gluing quick and very effective, since the glue bonds all along the inner side of a tube.

Increased safety results from the possibility that my system gives for having the strings loosely strung so that they tend to absorb the shock of hard hitting and to prevent vibration from traveling up the players arm. This sharply reduces "tennis elbow" and "tennis shoulder".

It is not uncommon for young tennis players, even starting at the ages of five to seven years old, to practice three or four hours a day, and later on to practice six hours a day in preparing for a tennis career. One of the main reasons for needing all this practice is to become expert at getting top spin on the ball. The amount of physical stress on a player is very great. But I have discovered that top spin abilities can be achieved and maintained with three hours of practice a day instead of six for excellent performance by using my racquet system for providing the top spin. Often a serious player has problems and pain in all parts of his body due to the starting and stopping of his whole body weight, because of long hours of practice. Cross country runners in track meets and in practice do not have such a problem of stopping and starting and the resultant body stress. It is important to be able to reduce the necessary hours of practice to reduce all this starting and stopping stress.

I have discovered that the very best advanced training for tennis players is achievable with my racquet because the looser strings make it impossible to get the ball back over the net without a full swing and follow through. Hence, using my racquet, the temptation to take a short hit at a ball is eliminated and the player does his best to get his body into a position for a full swing, which is the best habit.

I have found that my racquet is good for practice in preparation for using a conventional racquet. This is because the player develops confidence when he finds the ball going in the court resultant from his tendency to take a full stroke. Hence, he habitually uses full strokes when later playing with a conventional interwoven string racquet.

I have discovered that two independent layers of main strings on opposite sides of the racquet, each with their separate attached spinners, is very important. This is because the cross-strings of a single set of main strings would tend to be behind the main strings as they should be when the ball is hit on one side, but they would be in front of the main strings if the ball was hit on the other side of the racquet.

Therefore, with only one set of main strings it would be necessary to turn the racquet over in a hand in order to hit a back-hand stroke right after a fore-hand stroke. The time required to turn the racquet over is a split-second which is very important. Therefore, my solution is to provide a completely separate set of string and spinner combination unit for each side of the racquet so that the racquet will function equally when it hits the ball on each side of the racquet. This is done by having the cross strings extending between the two layers of main strings.

In tournament play, if both opponents have racquets of substantially equal quality, then there is a fairness achieved whether they are both playing with conventional racquets or both playing with my kind of racquet. But the pleasure of the game for both experts and amateurs will be greatly enhanced because it is more fun to see the ball you hit having adequate top spin to land inside the court.

I have found that my racquet system works on racquets made of any materials in common use today. It also works well on both over-sized and conventional size racquets.

The slice, or underspin is enhanced in the same way as the top spin but by a shifting of the ball-hitting strings in an upward direction with their following downmotion giving the underspin whereby there is no disadvantage and the advantages are appreciated by both beginners and experts.

The ball-grips, which are preferably the tubes of spinners, can be made from anyone of many materials, such as many thermoplastics, nylon, cord, wood, aluminum, cloth, rubber or leather, and the entire spinner can be made from such materials, although those that can be machine molded and be substantially rigid are much preferred.

SUMMARY OF THE INVENTION

The main goals of this invention are to provide a tennis racquet having at least mostly non-interwoven strings, a plurality of ball grips or string-protectors, each ball grip having an opening therethrough receiving a respective main string, retaining units holding each of the grips in a position along its main string, the grips being preferably multiple row-groups of grip-tubes each row-group being held together as a unit and called a spinner, the spinners being disposed spaced along the mains.

Another goal is to provide spinners with interconnecting portions recessed on their outer sides for increased ball gripping but smooth on sides facing the cross-strings for string protection.

DESCRIPTION OF THE PREFERRED EMBODIMENT

Figure 1:
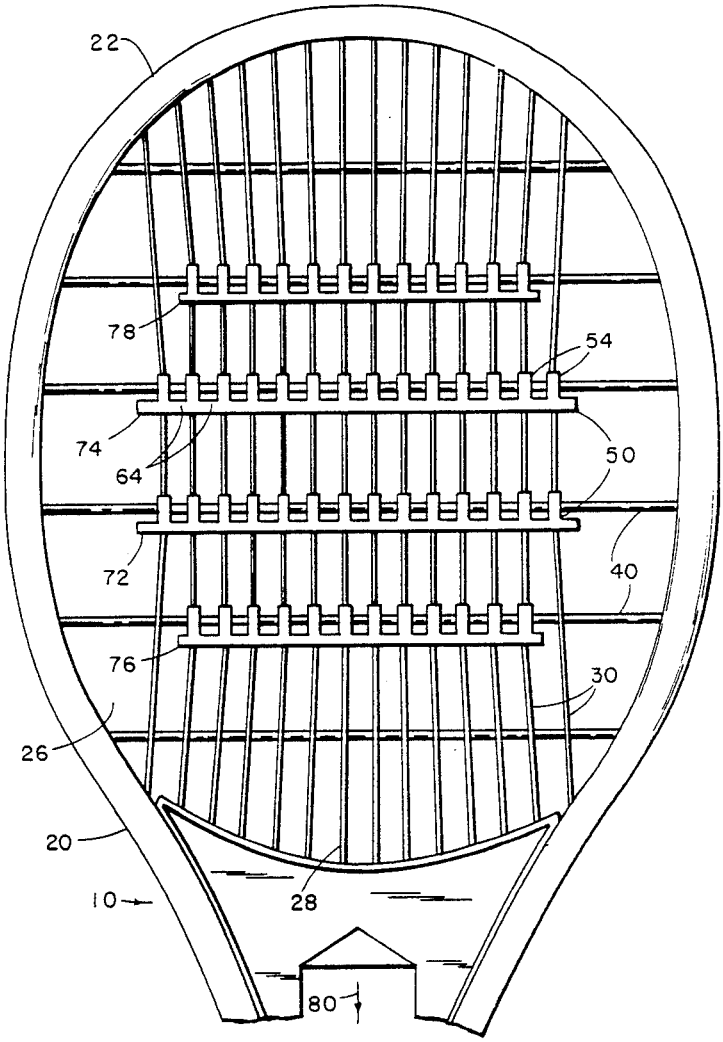
FIG. 1 is a top plan view of the outer end of a horizontally held tennis racquet of this invention with one ball-hitting side facing upward.

The tennis racquet of this invention is generally indicated at 10 in FIG. 1 and comprises a frame 20 having an outer end 22 and having an inner end on a underside, as seen in FIG. 1, but on a handle part that is not shown.

The frame 20 has a string opening 26 of conventional nature, although it can be of any size or shape within the principles of this invention.

The opening 26 has in it strings comprising main strings 30 and cross strings 40.

Figure 2:
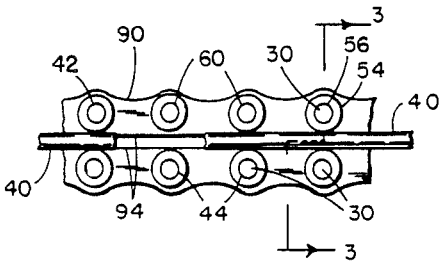
FIG. 2 is a view looking at a central portion of the stringed area of the racquet of FIG. 1, as seen from one end of a spinner, and showing only a central portion of that spinner and a central portion only of a spinner on the opposite side of the racquet with main strings received therethrough and with a cross-string shown with a part broken away.

The mains extend from the inner end of the opening 26 to the outer end thereof and are disposed alongside each other for the most part being in parallelism, but not exactly so, since the inner portions of all of the strings except a center string 28 of the main strings are somewhat arcuate with all strings to the right of the center string 28, as shown in FIG. 2, having their right sides convex and their left sides concave. All strings to the left of the center string 28 have their left sides convex and their right sides concave. The terms right and left, as regards the main strings 30, are used as applied to the position of the racquet when it is shown in FIG. 1. The cross strings 40 are themselves always in parallelism.

The cross strings 40 extend substantially at a right angle to the center string 28, therefore, at a right angle to an elongation of the string opening 26, which latter is elongated from its inner end to its outer end.

As best seen in FIG. 2, the mains 30 are disposed in two groups, a first group being seen at 42 and being disposed on one side of the crosses 40, and the other group being seen at 44 and being disposed on the other side of the crosses 40, so that one set of the mains 42 will strike a ball on a forehand swing, while the other set of mains 44 will, for example, strike a ball on a backhand swing when a racquet is held firmly in the player's hand between the forehand and backhand swings.

A plurality of spinners 50 are mounted on the mains 30. Each of the spinners 50 has a plurality of ball-gripping tubes 54 attached thereto, and each tube has an elongated opening 56 therethrough, in which a respective main 30 is received. A small amount of a suitable glue is disposed at 60 in FIG. 2, holding each respective tube 54 to its main. Capillary action will cause the liquid glue to seep along a main from one end of a tube during manufacture and the resultant effect is excellent attachment of the spinners to the mains.

Each spinner has its tubes 54 in parallelism alongside each other and spaced apart.

Each spinner 50 has connecting portions 64 extending between each two adjacent tubes thereof, and connecting the tubes together.

Each spinner with its tubes and connecting portions 64 is preferably made of one piece of thermoplastic material, and is substantially rigid, whereby the force of a ball striking any of the tubes of a spinner will be transferred to all other tubes of the same spinner and will even be transferred to all of the main strings connected to that spinner.

The spinners 50 are preferably four in number, of which two, shown at 72 and 74, can be called intermediate spinners, and of which two others, shown at 76 and 78, can be called inner and outer spinners, since the inner spinner 76 is closest to the inner or handle end of the racket, which latter is indicated in FIG. 1 by an arrow 80, which indicates the direction of the location of the inner end of the racket which is the handle, not shown.

The inner one of the spinners 76 is preferably disposed on one side of the second one of the mains 40 on the inner end 80 of the racket, and the other three spinners 72, 74 and 78 are sequentially on the third, fourth and fifth crosses 40 from the inner end 80.

Figure 3:
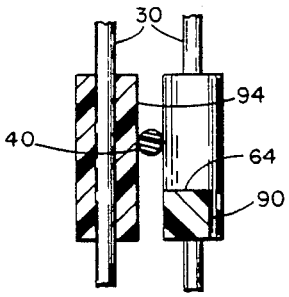
FIG. 3 is a left side elevation of the parts shown in FIG. 2 but with an adjacent half-portion of a tube broken away and with a bottom corner of a right tube broken away.

All of the above description of spinners 50 applies to only one side of the racquet and in FIG. 3 a sample spinner on that one side is seen at 90.

The other side of the racquet has a complete and identical second set of mains (one of which is shown at the left side of FIG. 3) bearing an identical second set of spinners (of which a sample is shown at 94 in FIG. 3).

The mains and spinners of the second set are for the same purposes as the mains and spinners of the first set whereby the player can hit the ball well from either side.

As seen in FIG. 3, each of the crosses 40 are between the tubes of spinners of the first and second sets. As best seen in FIGS. 1 and 3, the majority of the cross strings 40 are thicker than the majority of the mains.

I claim:

1. A tennis racquet comprising a frame having an outer end and an inner end, said frame having a string opening therethrough adjacent its outer end, strings comprising main string means comprising a plurality of single main string means defined as mains and cross string means comprising a plurality of single cross string means defined as crosses, a plurality of mains extending from the inner to the outer end of said opening and disposed alongside each other, a plurality of crosses disposed alongside each other and spaced with respect to each other and extending transversely of said mains, a plurality of ball grips, each ball grip having an opening therethrough receiving a respective one of said mains, means retaining each of said grips in a position along its main, a substantial number of said mains and crosses being free of interweaving whereby said strings yield more easily than the strings of a completely interwoven string racquet whereby the ball stays longer in contact with said strings for providing more control and whereby the jolt of the racquet striking the ball hard is lesser for reducing the corresponding jolt on the arm of the player, said strings being attached to said frame and extending across said opening, said outer end of said frame having two substantially planar oppositely facing sides, said mains in total and crosses in total each normally defining configurations having substantially planar outer surfaces parallel to said planar sides of said frame, said mains being in two groups, one of said groups of mains being on one side of said crosses and the other of said groups of mains being on the other side of said crosses, both of said groups of mains having said ball grips thereon whereby the benefit of said grips is available for striking a ball adjacent each of said groups of mains, said two groups of mains being out of contact with each other at all times, those of said grips which are disposed on one of said groups of mains being free of any connection to those of said grips which are disposed on the other of said groups of mains except such connection as is indirect through said strings, said ball grips being spaced ball gripping tubes disposed alongside each other, each tube having an elongated opening receiving a respective main, stiff connecting means interconnecting said tubes for defining a spinner whereby the tubes of a spinner move together as a unit, said connecting means extending transversely to the elongation of said tube openings, said interconnecting means being substantially smaller in a direction lengthwise of said tube openings than is the average length of said tubes along said openings, said interconnection means having portions between adjacent tubes each of which defines an interconnecting element, said interconnecting elements being in alignment, said elongated tube openings being substantially lying in a plane, said spinner having spaced projecting portions spaced apart along a line at a right angle to said tube openings and projecting outwardly from the plane of said tube openings farther than portions disposed between said tubes, said crosses being thicker than said mains and extending across the center area of said frame opening.

2. The tennis racquet of claim 1, said grips having connecting means interconnecting a group of said grips whereby movement of a grip in a group is affected by movement of the other grips in the same group whereby such a group of connecting grips defines a spinner.

3. The tennis racquet of claim 2 having the connecting means and the grips of each spinner being substantially a rigid unit.

4. The tennis racquet of claim 2 having the connecting means and the tubes of each spinner being substantially a rigid unit, the connecting means and the tubes of each spinner being formed of one piece of thermoplastic material.

5. The tennis racquet of claim 2 having the connecting means and the grips of each spinner being substantially a rigid unit, said connecting means being formed in connecting elements, each connecting element being between two adjacent grips of a spinner, each connecting element having a recess therein on a side thereof facing outwardly of said racquet whereby said connecting means does not reduce the spin-causing potential of the grips of a spinner.

6. The tennis racquet of claim 5 having the connecting means and the tubes of each spinner being formed of one piece of material, the number of spinners on each racquet-side being from 3 to 10, said crosses being in 6 places as seen from one side of said racquet, the number of mains per an outer side of said racquet being from 6 to 20, said racquet having a second and duplicate set of mains on an opposite side of said crosses, a second set of identical spinners secured on the second mains whereby said racquet looks the same in its strung area from either side thereof.

7. The tennis racquet of claim 5 having the connecting means and the tubes of each spinner being formed of one piece of thermoplastic material, the number of spinners on each racquet-side being 4 of which two are intermediate spinners and the others are an outer an an inner spinner, the number of crosses being 6, the number of tubes per spinner being 10 on two intermediate spinners and 12 on the inner and outer spinner, the number of mains per an outer side of said racquet being 14, said racquet having a second and duplicate set of mains on an opposite side of said crosses, a second set of identical spinners secured on the second mains whereby said racquet looks the same in its strung area from either side thereof.

8. The tennis racquet of claim 7 having said crosses being thicker than said mains, the number of said crosses being at least 3.

9. The tennis racquet of claim 1 having said crosses being thicker than said mains.

10. A spinner for attachment to the strings of a tennis racquet comprising a plurality of ball-gripping tubes disposed alongside each other, each tube having an elongated opening for extending along and receiving a string, and connecting means interconnecting said tubes whereby movement of any said tube is affected by movement of the other tubes, said spinner being free of elongated holes extending transversely to said openings, said connecting means being a stiff means extending transversely to the elongation to said tube openings, said interconnecting means being substantially smaller in a direction lengthwise of said tube openings than is the average length of said tubes along said openings, said interconnection means having portions between adjacent tubes, said elongated tube openings being substantially in parallelism and substantially lying in a plane, said spinner having spaced projecting portions spaced apart along a line at a right angle to said tube openings and projecting outwardly from the plane of said tube openings farther than portions disposed between said tubes.

11. The spinner of claim 10 having said connecting means and the tubes of each spinner being substantially a rigid unit, said connecting means being formed in connecting elements, each connecting element being between two adjacent tubes of a spinner, each connecting section having a recess therein on a side thereof facing outwardly of said racquet whereby said connecting sections do not reduce the spin-causing potential of the tubes of a spinner.

12. The spinner of claim 11 having said connecting elements being substantially smooth on the opposite side thereof from said recesses.

* * * * *